United States Patent [19]

Hall

[11] 4,116,602

[45] Sep. 26, 1978

[54] APPARATUS FOR COMPACTING MULTI-SECTIONAL PARTICULATE CONTAINING FILTERS

[75] Inventor: Floyd Van Hall, Durham, N.C.

[73] Assignee: Liggett Group Inc., Durham, N.C.

[21] Appl. No.: 887,564

[22] Filed: Mar. 16, 1978

Related U.S. Application Data

[63] Continuation of Ser. No. 764,575, Feb. 1, 1977, abandoned.

[51] Int. Cl.[2] ..... B30B 11/08; A24C 5/48

[52] U.S. Cl. ..... 425/354; 425/352; 131/20 R; 131/94

[58] Field of Search ..... 425/352, 354, 403.1, 425/394, 356; 264/109; 131/20 R, 94

[56] References Cited

U.S. PATENT DOCUMENTS

| | | | |
|---|---|---|---|
| 427,578 | 5/1890 | Knickerbocker | 425/354 X |
| 506,807 | 10/1893 | Beardsley | 425/352 |
| 1,026,682 | 5/1912 | Komarek | 425/354 X |
| 2,888,935 | 6/1959 | Eissmann | 131/94 |
| 2,898,998 | 8/1959 | Schur | 131/94 X |
| 3,354,887 | 11/1967 | Hall | 131/94 |
| 3,715,957 | 2/1973 | Hall | 131/94 |
| 3,778,328 | 12/1973 | Beard | 131/94 |
| 3,999,922 | 12/1976 | Shimada | 425/354 X |
| 4,047,866 | 9/1977 | Shah | 425/354 X |

*Primary Examiner*—Robert L. Spicer, Jr.
*Attorney, Agent, or Firm*—J. Bowen Ross, Jr.; Michael L. Hendershot

[57] ABSTRACT

A multi-sectional filter tip assembly is initially made with two charcoal filter sections and alternate sections of cellulose acetate fibrous material with a fibrous section at each end. The filter tip assembly is then compacted by a pin compactor which punches a recess into each fibrous end of the filter tip assembly while at the same time forcing the displaced acetate fibrous material into the charcoal sections to compact the charcoal. Upon removal of the pins of the pin compactor, a recess is formed in each end of the filter tip assembly.

3 Claims, 11 Drawing Figures

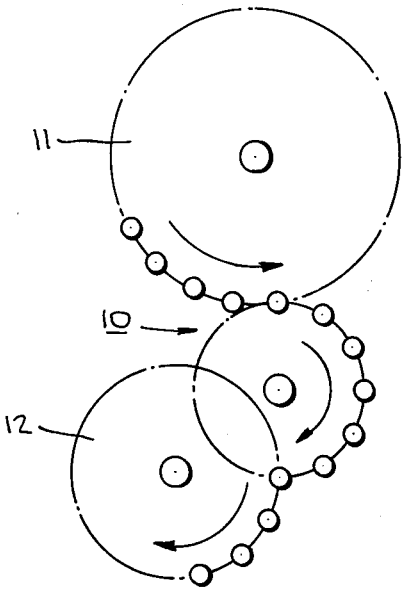
Fig. 1.
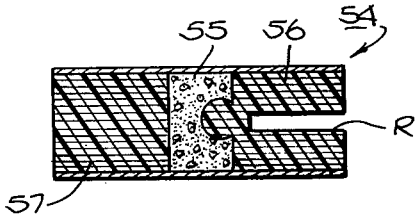
Fig. 10.
Fig. 7.
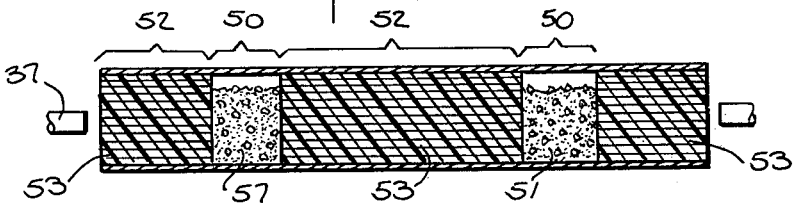
Fig. 8.
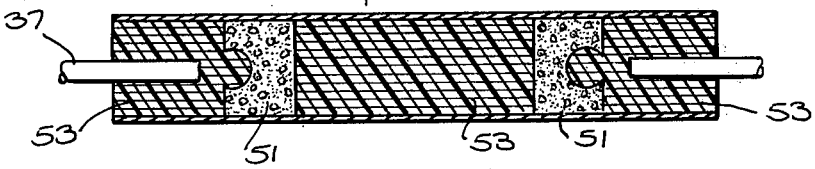
Fig. 9.
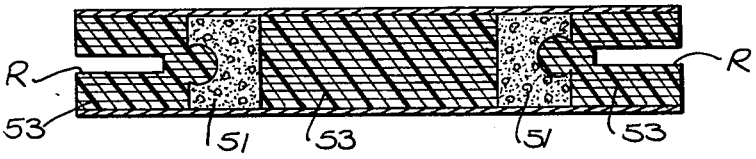
Fig. 11.
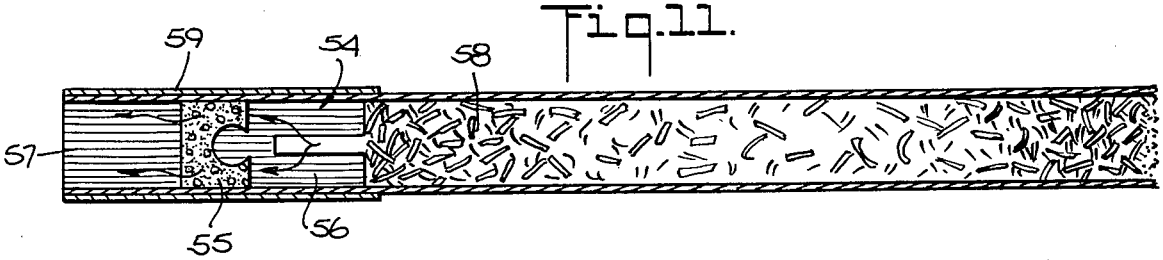

APPARATUS FOR COMPACTING MULTI-SECTIONAL PARTICULATE CONTAINING FILTERS

This is a continuation of application Ser. No. 764,575, filed Feb. 1, 1977 now abandoned.

This invention relates to an apparatus and method for compacting multi-sectional particulate-containing filters.

As is known, filters for cigarettes have been constructed of various types of materials. For example, one known type of multi-sectional filter has been made with two spaced apart sections of an entrainment-type filter material, such as plugs of cellulose acetate, with an intermediate section filled with a granular adsorption-type filter material such as charcoal or other particulate material. Generally, this type of filter is fabricated by injecting the charcoal between spaced plugs of cellulose acetate on a strip of wrapper paper and then wrapping the paper about the filter materials to form a continuous rod of repeating sections of filter material. Thereafter, the rod is severed into lengths to form two or more filters. However, in some situations, the charcoal or particulate material which is provided in such filters has not completely filled the space between the cellulose acetate sections. Because this may result in a less efficient filter, efforts have been made in the past to exert axial compaction forces on the filters after fabrication so as to force the cellulose acetate plugs inwardly and, thus, reduce the size of the section in which the particulate material is located, e.g. as described in U.S. Pat. Nos. 3,715,957 and 3,354,887. Generally, the filters which are compacted in this manner show a recessed end since the acetate plugs become recessed with respect to the plug wrapping paper. Thus, when jointed to a tobacco column, the recessed end must either be abutted against the tobacco column leaving a small space or exposed at the end of the cigarette. In either case, there are undesirable effects. For example, in the first case, there is a weakened joint between the filter and tobacco column while, in the second case, the exposed recess is not aesthetically pleasing.

Accordingly, it is an object of the invention to provide a compacted multi-sectional particulate-containing filter of pleasing appearance.

It is another object of the invention to provide a compacted multi-sectional particulate-containing filter which is capable of abutting a tabacco column in a secure manner.

It is another object of the invention to provide a multi-sectional particulate-containing filter which uses a minimum of particulate material.

It is another object of the invention to provide a filter which is capable of routing smoke radially as well as laterally.

It is another object of the invention to provide an apparatus for efficiently making filter tip assemblies.

It is another object of the invention to provide a simple apparatus for compacting multi-sectional particulate-containing filter tip assemblies.

It is another object of the invention to provide a simple apparatus which can be placed on existing machinery for compacting multi-section filter tip assemblies.

It is another object of the invention to provide a simple method of compacting multi-sectional particulate-containing filters.

Briefly, the invention provides an apparatus and method for compacting multi-sectional particulate containing filters.

The apparatus is adapted to be mounted on a filter tip cigarette making machine and comprises a rotatable shaft, a transfer drum mounted on the shaft for rotation therewith, a pair of punch wheels mounted on the shaft for rotation therewith, a plurality of punches in the punch wheels and a pair of cams stationarily mounted about the shaft.

The transfer drum has a plurality of circumferentially spaced peripheral grooves for receiving filter tip assemblies, for example as described in U.S. Pat. No. 3,715,957. The punch wheels are disposed on opposite sides of the transfer drum and each has a generally cylindrical peripheral sleeve defining outwardly directed undulations and grooves on the opposite sides of the undulations. Each groove is aligned with a respective groove of the transfer drum for alignment with a filter tip assembly received in the drum groove. Each of the punches is slidably mounted in a respective groove of a punch wheel and each of the cams is disposed between the shaft and the respective one of the sleeves of the punch wheels for guiding the punches reciprocally within the sleeves into and out of the respective grooves of the transfer drum. The shaft of the compacting apparatus is adapted to be secured to a rotatable member in the filter tip cigarette making machine frame while the undulations of the punch wheels mesh with and between a filter tip separating drum and a cigarette assembly drum.

Each of the cams is provided with a raised cam track while each of the punches has a recess in which the cam track is received. As the transfer drum rotates and carries along the punch wheels, the punches are moved along the cam track into and out of the recesses of the transfer drum. To this end, each of the punches is constructed with a pin which extends in a direction towards the transfer drum for compacting a filter tip assembly on the drum. For this purpose, each pin is of smaller cross section than a respective groove of the transfer drum as well as the filter assembly in the groove.

In order to hold the cams in a stationary manner, suitable means are provided to fix the cams to the frame of the machine. For example, the means for securing the cams to the frame includes two pairs of cam holders and a stud. The pairs of cam holders are mounted on the stud in spaced apart relation and each pair is connected to a respective cam at two spaced apart points. The stud, in turn, is secured as by threading to the frame. In this way, the cam holders and stud serve to suspend the cams from the machine frame without interferring with the operation of the respective drums.

The method of the invention is directed to the compaction of multi-sectional filter tip assemblies containing a pair of spaced particulate adsorption-type filter sections and alternate sections of entrainment-type filter material. The method comprises the step of moving a punch into each of the opposite ends of a filter assembly to force a portion of the entrainment-type filter material at each end of the assembly into an adjacent interior particulate filter section in order to displace and compact the particulate filter material in the section while, at the same time, forming a recess in each of the opposite ends of the filter assembly. The method is carried out while a series of filter assemblies are conveyed on a rotating transfer drum.

The action of the compaction apparatus on a filter assembly results in a filter which has a compacted chamber of particulate filter material disposed between two sections of entrainment type filter material. In addition, one of the entrainment-type filter sections is provided with an elongated recess while the material displaced from this recess substantially projects into the chamber containing the particulate material. Such a filter can be placed on a tobacco column from either end. In either case, a substantial portion of the end of the filter is abutted against the tobacco column so as to ensure a secure joint when the filter is joined to the tobacco column. Should the recessed end be abutted against the tobacco column, the smoke, in following the path of least resistance, will first flow into the recess and then flow substantially radially into the fibrous material of the filter section before passing into the particulate material chamber. Further, should the recessed end be the exposed end for a cigarette, the recess does not impair the aesthetic appearance of the cigarette.

By compacting the particulate material in the above manner, the section containing the particulate material is substantially filled to capacity. As a result, smoke which subsequently passes through the filter during smoking must pass over the particulate material. As a result, the filtering capacity of the particulate material can be maximized. Further, since the particulate section can be compacted in a relatively simple manner, it is possible to use less particulate material within this section.

These and other objects and advantages of the invention will become more apparent from the following detailed description and appended claims taken in conjunction with the accompanying drawings in which:

FIG. 1 illustrates a schematic view of a compacting apparatus disposed between a filter separating drum and a cigarette assembly drum of a filter tip cigarette making machine;

FIG. 7 illustrates a cross-sectional view of a filter tip assembly prior to compaction;

FIG. 8 illustrates a cross-sectional view of a filter tip assembly during compaction;

FIG. 9 illustrates a cross-sectional view of a filter tip assembly after compaction;

FIG. 10 illustrates a compacted multi-sectional filter compacted in accordance with the invention; and FIG. 11 illustrates a filter tip cigarette employing the compacted filter of FIG. 10.

Referring to FIG. 1, the compaction apparatus 10 is positioned between a filter tip separating drum 11 and a cigarette assembly drum 12. As indicated, filter tip assemblies 13 are delivered by the separating drum 11 onto the compaction apparatus 10 and thereafter directed onto the cigarette assembly drum 12 in known manner.

Figure 2:
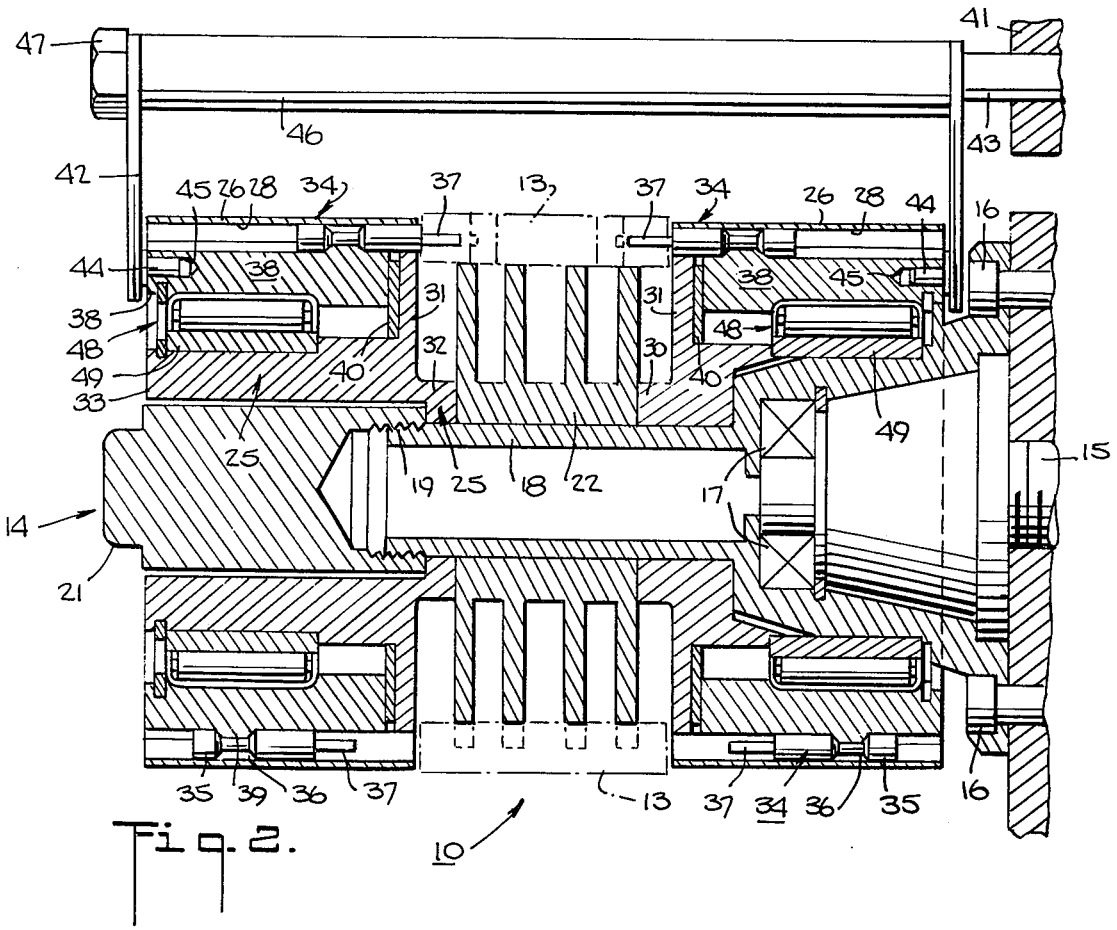
FIG. 2 illustrates a cross sectional view of a compaction apparatus according to the invention.

Referring to FIG. 2, the compaction apparatus 10 includes a shaft 14 which is rotatably mounted in a frame 15 of a filter tip cigarette making machine (not shown) via bolts 16. The frame 15 is, in turn, rotatably driven by the same mechanism that drives the separating drum 11 and assembly drum 12. Each of the drums 11, 12 and compaction apparatus 10 have the same peripheral speed which is provided by a suitable gear train (not shown). As shown, the shaft 14 is formed of a contoured spindle 18 having a threaded end 19 and a nut 20 which is threaded at one end so as to thread onto the spindle 18. The opposite end of the nut 20 is provided, for example, with a hexagonal head 21 so as to permit threading onto the spindle 18.

The compaction apparatus 10 also includes a transfer drum 22 which is mounted on the shaft 14 for rotation therewith. This drum 22 has a plurality of circumferentially spaced peripheral grooves 23 for receiving the filter tip assemblies 13 and is of generally known construction, for example as described in U.S. Pat. No. 3,715,957.

In addition, a pair of punch wheels 24, 25 are mounted on the shaft 14 for rotation therewith. Each punch wheel 24, 25 has a generally cylindrical peripheral sleeve 26 which defines outwardly directed undulations or flutes 27 on the outside surface and grooves 28 on the opposite sides of the undulations, i.e. on the inside surface (see FIG. 3). Each of these grooves 28 is aligned with a respective groove 23 on the transfer drum 22. As indicated, the inner punch wheel 24 is mounted directly on the spindle 18 and abuts against a shoulder 29 of the spindle 18 as well as against the transfer drum 22. As shown, the inner punch wheel 24 is generally of cup shaped configuration and includes a main body portion 30 which is seated on the spindle 18 and an outwardly directed disc-like portion 31 which is integral with the sleeve 26. The other punch wheel 25 also abuts against the transfer drum 22 as well as against the spindle nut 20. Thus, upon tightening of the nut 20 on the spindle 19, the punch wheels 24, 25 and the transfer drum 22 are locked to the shaft 14. The outer punch wheel 25 is similar to the inner punch wheel 24 with respect to the integral nature of the sleeve 26 to a disc-like portion 31. However, the outer punch wheel 25 has a small shouldered portion 32 which is fitted onto the spindle 18 between the drum 22 and nut 14 and a larger body portion 33 which is spaced about the spindle nut 19.

Figure 4:
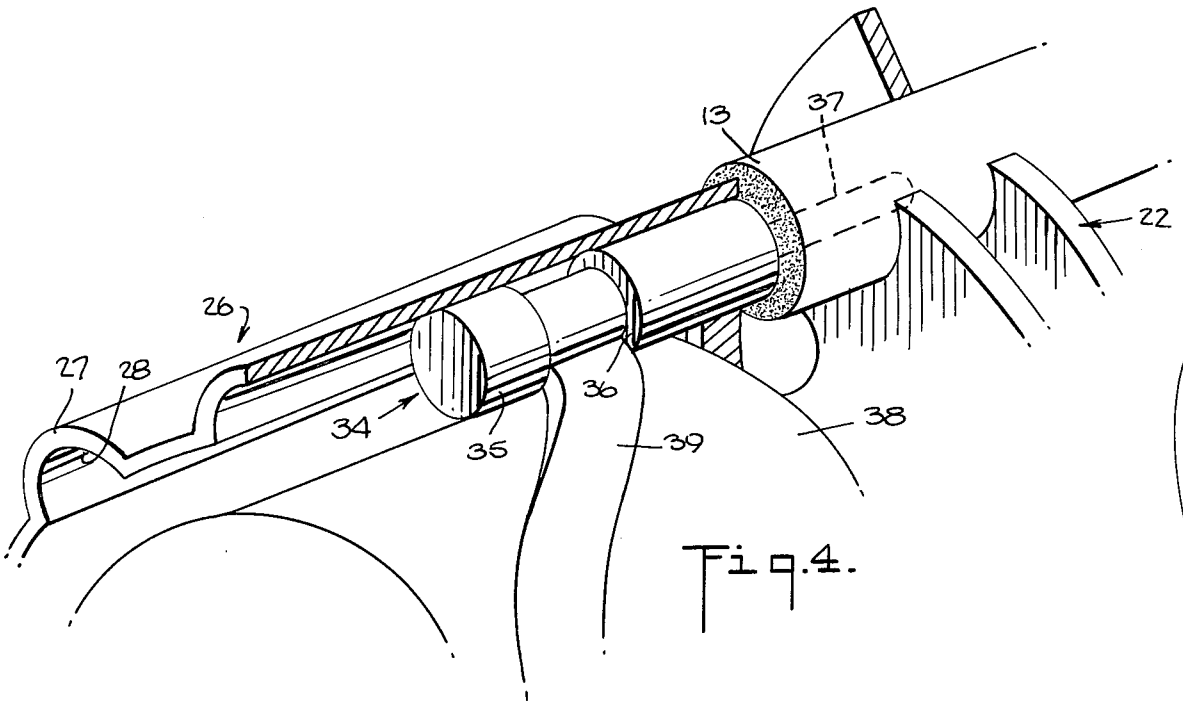
FIG. 4 illustrates a perspective view of a pin on a cam in accordance with the invention.

Referring to FIGS. 2 and 4, a plurality of punches 34 are slidably mounted in the grooves 28 of the punch wheels 24, 25. As shown in FIG. 4, each punch 34 is formed with a main body portion 35 which contains a recess 36 in an intermediate section as well as a pin 37 which extends from the main body portion 35 and is of reduced cross-section relative to the body portion 35. As shown in FIG. 2, each pin 37 extends in a direction towards the transfer drum 22 and is of smaller cross-section than the groove 23 in the drum as well as the filter assembly 13 which is in the groove 23.

The compaction apparatus 10 also includes a pair of cams 38 which are stationarily mounted within which the shaft 14 rotates. Each of these cams 38 is of annular shape and is disposed between the shaft 14 and a sleeve 26 of the respective punch wheels 24, 25 for guiding the punches 34 reciprocally within the sleeve 26 into and out of the grooves 23 of the transfer drum 32. To this end, each cam 38 has a raised cam track 39 (see FIGS. 5 and 6) on which the punches 34 ride via the recesses 36. As indicated, the punches 34 roll along the outer cylindrical surfaces of the cams 38.

Figure 3:
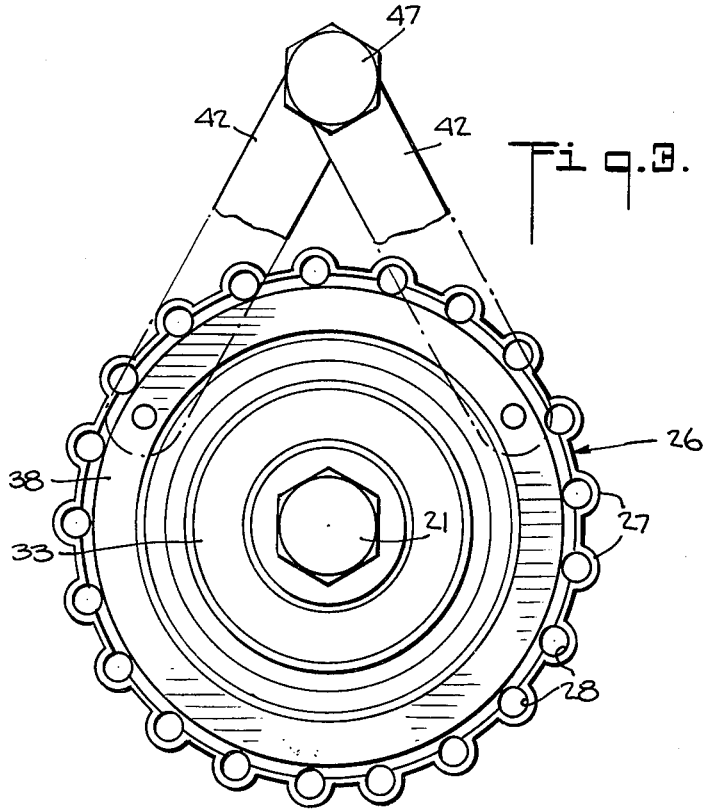
FIG. 3 illustrates an end view of the compaction apparatus of FIG. 2.

A suitable bearing disc 40 is disposed between each cam 38 and the disc-like portion 31 of each punch wheel 24, 25 so as to permit relative rotation between the punch wheels 24, 25 and the stationary cams 38. In addition, a suitable means is provided for securing the cams 38 in a stationary fashion to a part of the machine frame 41. As shown in FIGS. 1 to 3, this means includes two pairs of cam holders 42 and a stud 43. The cam holders 42 are in the form of links which are provided with an aperture (not shown) at one end so as to fit over the stud 43 and a projecting pin 44 at the opposite end so as to fit within a matching recess 45 in a cam 38. In addition, the securing means includes a spacer 46 which is disposed between the two pairs of cam holders 42. The stud 43 is threaded at one end so as to be threaded into the machine frame part 41 and includes a thread at the opposite end to receive a securing nut 47 to fix the cam holders 42 and spacer 46 in place.

Referring to FIG. 2, suitable roller bearings 48 are positioned between the cams 38 and the punch wheels 24, 25 to permit relative rotation between the rotating punch wheels 24, 25 and the stationary cams 38. Each bearing 48 includes an inner race 49 fixedly mounted on a body portion 30, 33 of a punch wheel 24, 25.

Referring to FIG. 1, when the compacting apparatus 10 is positioned in place, the undulations 27 provided by the punch wheels 24, 25 are in meshing engagement with the respective separating drum 11 and assembly drum 12. Thus, upon rotation of the separating drum 11 via a suitable drive (not shown) the punch wheels 24, 25 and associated transfer drum 22 and shaft 14 are caused to rotate. However, the cams 38 remain stationary via the connection to the frame 41 provided by the cam holders 42 and stud 43.

Figure 5:
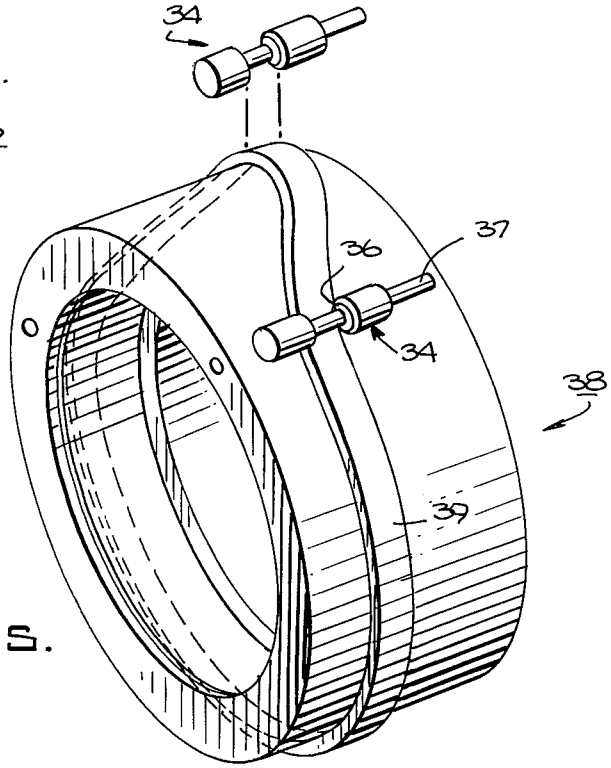
FIG. 5 illustrates a perspective view of a cam having a raised cam track and an associated pin in accordance with the invention.
Figure 6:
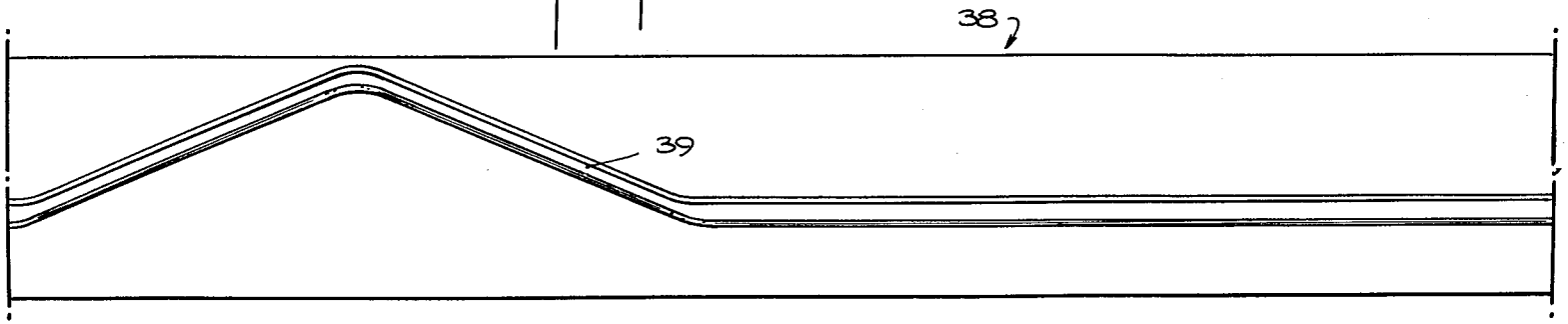
FIG. 6 illustrates a developed view of the cam track according to the invention.

Referring to FIG. 5, during rotation of the punch wheels 24, 25, the punches 34 roll along the cams 38 and the raised track 39. As the punches 34 move along the distorted portion of the cam track 39, the pins 37 move into the recesses 23 of the transfer drum 22 and into the filter tip assemblies 13 in the grooves 23.

Referring to FIG. 7, each of the filter tip assemblies 13 is of the multi-sectional particulate-containing type. To this end, each filter tip assembly 13 includes a pair of particulate-containing sections 50, for example containing charcoal 51 and alternate sections of entrainment-type filter material 52, for example plugs of cellulose acetate 53.

Referring to FIG. 8, as the pins 37 are moved into the filter tip assemblies 13, the pins 37 force material from the outer cellulose plug sections 52 into the charcoal containing sections 51. This displaced material forces the charcoal 51 to displace and compact within the section 50. Thereafter, continued rotation of the transfer drum 22 and associated punch wheels 24, 25 causes the pins 37 to retract leaving a recess R within the outer plugs 53 of the filter tip assemblies 13 as shown in FIG. 9. Thereafter, each filter tip assembly 13 is severed at the midpoint to produce two filters. A resultant filter 54, as shown in FIG. 10, thus includes a compacted particulate section 55, a recessed entrainment-type filter section 56 and an unrecessed entrainment-type filter section 57. Such a filter 54 can thus be abutted against a tobacco column 58 and strip of mouthpiece paper 59 wrapped about the abutted filter 54 and tobacco section 58 to form a filter tip cigarette. As shown in FIG. 11, the filter 54 may be abutted with the recess end against the tobacco column 58 or may be joined to the tobacco column with the recess end at the exposed end of the cigarette (not shown). In the first case, smoke which passes from the tobacco column 58 initially follows the path of least resistance and passes into the recess and then passes with a radial component into the cellulose acetate of the section 55 before passing into the charcoal section 56.

As an example of the dimensions of the various components of the compaction apparatus, the pin 37 of each punch 34 has a diameter of 0.062 inches (1.5 mm) and is of a length of about 0.817 inches (22.5 mm). The pin 37 is moved into a filter tip assembly 13 so as to produce a recess about 18 millimeters deep.

I claim:

1. In combination with a multi-sectional particulate containing cigarette filter tips having spaced apart fibrous filter sections defining a cavity being partially filled with a granular material, an apparatus for moving a portion of the filter fibers of one filter section into the cavity whereby said cavity is filled with granular material and filter fibers protruding therein comprising a rotatable shaft;

a transfer drum mounted on said shaft for rotation therewith, said drum having a plurality of circumferentially spaced peripheral grooves for receiving said filter tips;

a pair of punch wheels mounted on said shaft for rotation therewith, each said punch wheel having a generally cylindrical peripheral sleeve defining outwardly directed undulations and grooves on the opposite side of said undulations, each said groove being aligned with a respective groove of said transfer drum;

a plurality of punches, each said punch being slidably mounted in a respective groove of said punch wheel and each said punch having a pin mounted on the end thereof and extending in the direction towards said transfer drum and being in alignment with said filter tips residing in said transfer drum peripheral grooves, each said pin being of a smaller cross-section than the aligned filter tip; and cam means mounted about said shaft and in contact with said punches, said cam means being adapted to guide said punches reciprocally within said respective sleeve to cause said pins to engage said filter tips and move a portion of said filter fibers to protrude into said cavity to compact a portion of said granular material in said cavity and thereby forming a recess therein.

2. An apparatus as set forth in claim 1 wherein said cam means is of annular shape and has a raised cam track thereon, and each punch rolls along an outer surface of said raised cam and has a recess slidably mounting said raised cam track therein.

3. An apparatus as set forth in claim 2 which further comprises means for mounting said cams in stationary manner.

* * * * *